United States Patent [19]

Striebel

[11] Patent Number: 4,837,557

[45] Date of Patent: Jun. 6, 1989

[54] COMBINATION ALARM AND LOCK DEVICE WITH SENSITIVITY ADJUSTMENT

[75] Inventor: R. Michael Striebel, West Lafayette, Ind.

[73] Assignee: Raywheel, Inc., Everett, Wash.

[21] Appl. No.: 240,374

[22] Filed: Aug. 30, 1988

Related U.S. Application Data

[63] Continuation of Ser. No. 164,497, Mar. 4, 1988, abandoned.

[51] Int. Cl.[4] ..... G08B 13/08; H01H 3/16

[52] U.S. Cl. ..... 340/546; 200/61.71; 200/286

[58] Field of Search ..... 340/545, 546; 200/61.71–61.75, 61.81, 61.82, 61.93, 61.62, 286, 249, 259; 292/338, 339

[56] References Cited

U.S. PATENT DOCUMENTS

| | | | |
|---|---|---|---|
| 2,870,281 | 1/1959 | Mitchell | 340/546 X |
| 3,742,479 | 6/1973 | Williams | 200/61.93 X |
| 3,778,806 | 12/1973 | Williams | 340/545 X |
| 3,797,005 | 3/1974 | Schwarz | 200/61.93 X |
| 4,057,773 | 11/1977 | Cohen | 200/61.76 X |
| 4,151,520 | 4/1979 | Full | 340/546 X |
| 4,193,067 | 3/1980 | Hawkins | 340/546 |
| 4,266,216 | 5/1981 | Trusty | 340/546 |
| 4,292,629 | 9/1981 | Kerr et al. | 200/61.72 X |
| 4,358,758 | 11/1982 | Morton | 340/546 |
| 4,495,486 | 1/1985 | White | 200/61.93 X |
| 4,553,134 | 11/1985 | Holt | 200/61.93 X |

*Primary Examiner*—Glen R. Swann, III
*Assistant Examiner*—Thomas J. Mullen, Jr.
*Attorney, Agent, or Firm*—Woodard, Emhardt, Naughton Moriarty & McNett

[57] ABSTRACT

A security device for installation adjacent a sliding door or window to detect movement thereof. A pair of telescopically constructed tubes include a plurality of batteries connected together to an audio alarm and visual alarm. A pair of movable contacts are disposed between the source of electrical power and the alarms and are movable together to complete the circuit by a depressible switch activated by the sliding door or window. The switch includes a rigid member slidably mounted to the tube with a threaded member fixed to the rigid member and extending towards the movable contacts. An adjustable nut threaded to the end of the threaded member allows for presetting of the space between the switch and the contacts thereby adjusting the sensitivity of the switch and security device to the movement of the sliding door or window.

15 Claims, 3 Drawing Sheets

COMBINATION ALARM AND LOCK DEVICE WITH SENSITIVITY ADJUSTMENT

BACKGROUND OF THE INVENTION

Cross-reference to Related Application

This application is a continuation of application Ser. No. 164,497, filed Mar. 4, 1988, now abandoned.

Field of the Invention

This invention is in the field of burglar alarm systems utilized with sliding doors or windows. In the commonly owned parent application there is disclosed a tubular device having a visual and audio alarm connectable to a plurality of batteries and operable by a push button switch mounted to one end of the tube. The tube is installed adjacent the sliding door or window so that the switch will be depressed upon movement of the door or window thereby activating the alarm. The frame surrounding a sliding door or window dimensionally varies from unit to unit and as a result, there is a need within the aforementioned security device to include an adjustment means for setting the trigger mechanism in accordance with the door or window frame construction. Likewise, it is desirable to preset the sensitivity of the security device so that it will trigger the alarm with the particular desired movement of the door or window. In other words, it may be desirable to trigger the alarm with only a small movement of the door or window or with a relatively great amount of movement.

The security device disclosed herein does a number of things in addition to allowing for the presetting of the sensitivity of the device. The device securely prevents opening of the sliding window or door. It is a bar and a jamming member, which purely and simply, when in place, will not allow sliding action, of sufficient amount, as will permit the door or window to open allowing an entry.

Equally as important, when in place, any initiation of movement by an intruder of the window or door element will actuate immediately a switch, which in turn, immediately and promptly energizes two independent alarm features. One of the alarms is a loud piercing high frequency sound which is shrill, alarming and surprising and motive defeating. The second alarm is a bright light which instantaneously floods the individual and the door or window with light directed in the manner desired by the occupant and arranged to achieve a most startling effect upon the would be intruder.

The prior art is replete with devices and apparatus which have been designed to provide security and to bar entry into various doors and windows of dwellings and the like. One such device is shown in U.S. Pat. No. 4,358,758. Further illustrative of prior art apparatus are those shown in U.S. Pat. Nos. 4,266,216 issued to Trusty; 2,870,281 issued to Mitchell; 4,193,067 issued to Hawkins; 3,778,806 issued to Williams; 4,495,486 issued to White; 4,151,520 issued to Full; and, 3,742,479 issued to Williams.

Many of these devices are designed only to be used on swinging doors while others are unsightly and complicated. Other of the patented devices are anything but simplistic. Most fail to actually bar entry and are only alarms. Other devices are of limited utility or require mounting installations such as drilled holes, modifications of the surrounding area or the like. Many of the prior art devices are clearly expensive, part due to the complicated nature of their construction. Certain of the devices are not only complicated, but involve exterior components which detract from their portability and shipability and adversely effect marketability.

SUMMARY OF THE INVENTION

One embodiment of the invention is a portable, self-contained security device for sliding doors or windows comprising elongate means adapted for positioning, in axial alignment with the plane of a sliding door or window and in the marginal path of its normally sliding opening to prevent opening, electrical power source means mounted to the elongate means, alarm means mounted to the elongate means and connectable to the electrical power source means, depressible switch means mounted to an end of the elongate means and including first and second contacts mounted to the elongate means and movable means mounted to an end of the elongate means and associated with the contacts being operable to move the contacts together and connect the electrical power source means with the alarm means when the switch means is depressed by movement of the sliding door or window, and, adjustable means operable to adjustingly control the spacing between the contacts and the movable means allowing presetting of sensitivity of the switch means to movement of the sliding door or window.

It is an object of the present invention to provide a new and improved security device for sliding doors and windows.

A further object of the present invention is to provide a sliding door or window security device having adjustment means for presetting the sensitivity of the device.

In addition, it is an object of the present invention to provide a sliding door or window security device having new and improved switching means for connecting an alarm with a source of electrical energy.

Related objects and advantages of the present invention will be apparent from the following description.

DESCRIPTION OF THE PREFERRED EMBODIMENTS

Figures 1, 4:
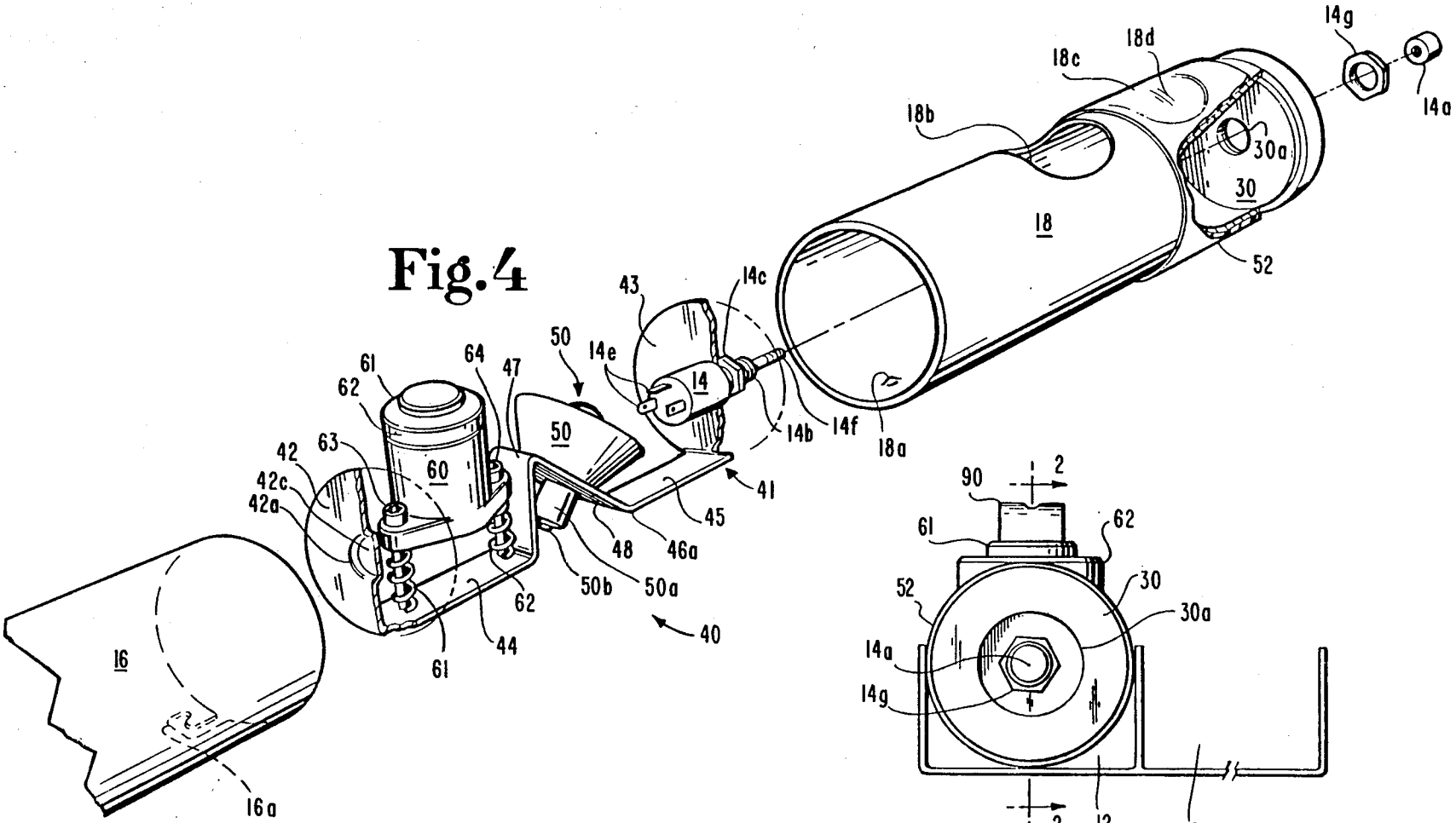
FIG. 1 is an axial end view of one embodiment of the elongate tubular alarm and lock device.
FIG. 4 is a perspective view, partially disassembled, of the device of FIG. 2 with portions shown axially exploded, and with parts broken away for purposes of illustrating the interior detail of construction.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
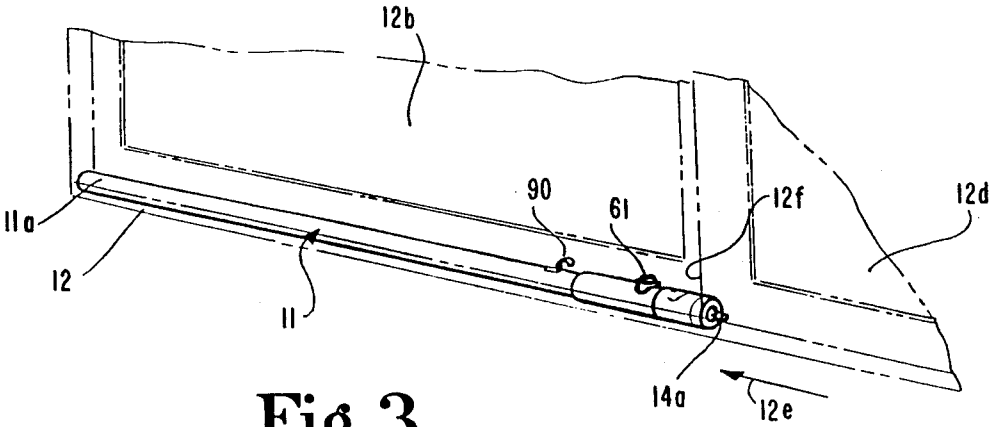
FIG. 3 is a perspective view of the device of FIG. 2 located in the bottom-most track for a sliding patio door.

Referring now more specifically to the drawings, there is disclosed therein, the alternate embodiment including an elongate tubular combination alarm and lock device 11 which, in FIGS. 1 and 3 is shown lying horizontally in a channel-like track 12 with its one end 11*a* abutting the vertical jam of a sliding door assembly. The assembly includes two windowed patio doors 12*b* and 12*d* and tracks 12 and 12*a* (FIG. 1). Each track contains the similar windowed patio door 12*b* and 12*d* slidable therein. The lock device 11 in channel track 12, prohibits and precludes movement of the patio door 12*d* in the opening direction of the arrow 12*e* because the device 11 already fills the track 12. As indicated, the device effectively bars or prohibits movement of the patio door 12*d* short of violently breaking the window or door.

Additionally, the device 11, in a manner as will be described, includes a double alarm feature which is actuated by any attempt to move the patio door 12*d* in the direction indicated by the arrow 12*e*; principally, because such movement of the patio door 12*d*, will cause its contact with contact 14*a* projecting axially from switch assembly 14 which is a part of the device 11 as will be described.

Figure 2:
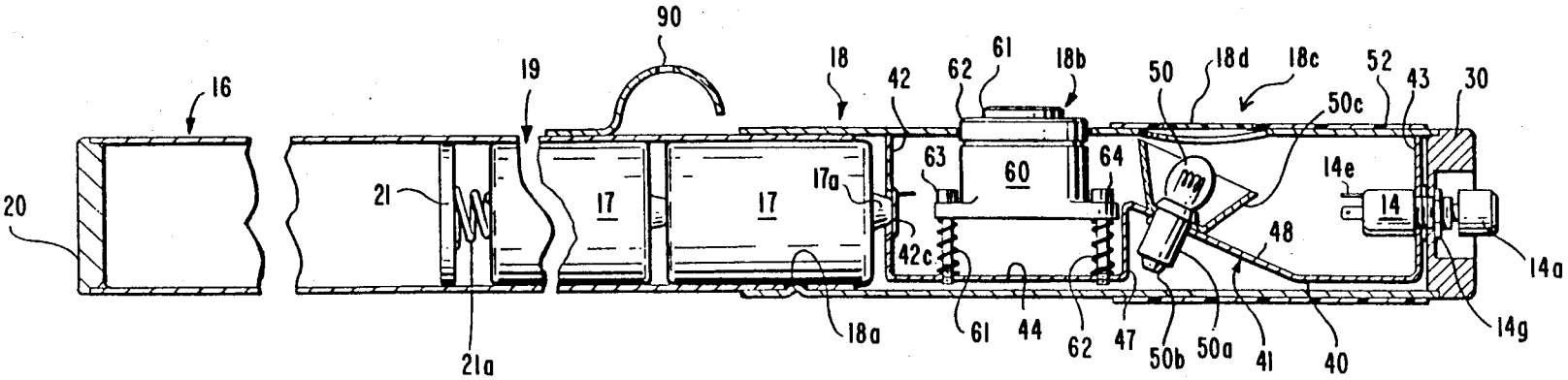
FIG. 2 is a fragmentary cross-sectional view taken along the line 2—2 of FIG. 1 and viewed in the direction of the arrows.

Referring now more particularly to FIGS. 2 and 3, the device 11 of the present invention is composed of two hollow, elongate tubular sections 16 and 18. Tubular section 16 serves as a spacer and housing for four 1.5-volt batteries 17, of which only two are shown in FIG. 2, due to broken away section, as at 19, for the purpose of reducing size for illustration purposes. Tubular section 16 includes a closure end cap 20 at the terminal end and additionally, a circular spacer 21 which is soldered at its outer periphery to the interior wall of section 16 and serves as a seat for spring 21*a* bearing against the end most of the series of batteries to urge them forward to insure electrical contact as described hereinafter.

Tubular section 18 is slightly larger in diameter than the section 16 and specifically with an I.D. which slidingly receives the end of the tubular section 16 opposite the cap 20 with securement provided by a dimple 18*a* on section 18 projecting inwardly for engagement with a bayonet type slot 16*a* in section 16. The amount of telescoping (about 2 inches), contributes to the axial strength of the overall device in serving to bar the opening of the sliding patio door or the like.

End cap 30, featuring a central aperture 30*a*, to accommodate switch 14, snaps into the outer cylindrical end of the section 18. Tube section 18 is also provided with two side-by-side arcuate cut outs 18*b* and 18*c* for purposes described hereafter.

Slidingly situated within the tubular section 18 is a bracket and dual alarm assembly 40 (see FIG. 4). The one-piece bracket 41 includes end segments 42 and 43 generally concentric with the I.D. of tubular section 18. Spaced linear segments 44 and 45 are shown extending respectively from the circular segments 42 and 43 and normal thereto but bent midway to define a perpendicular segment 47 and at 46*a* an inclined segment 48.

The switch assembly 14 is centrally mounted on the end segment portion 43 as shown (FIG. 4) with the main part of the switch 14 and switch terminals 14*e* located interiorly in the tube section 18 while a threaded extension 14*b* and axial armature 14*f* extend exteriorally through an appropriate aperture in the end segment 43 and is held by nut 14*c*, while the remaining portion of the threaded segment 14*b* extends through aperture 30*a* of cap 30 and is engaged by threaded nut 14*g* to properly hold the switch in secure operative fashion (FIG. 2), with the alarm components of the device of the present invention. Switch contact tip 14*a* telescopes onto armature rod 14*f* and carries contact pressure to the armature and thence to switch interior to actuate the flow of current as described hereinafter.

Movement of the rod like armature 14*f* axially into the switch turns the switch sequentially either "on" or "off". In other words, it either completes or interrupts the flow of current from the batteries to the alarm light and alarm buzzer in accordance with the circuit established by appropriate wiring from the switch terminals 14*e* to the respective positive and negative terminals of the light, the buzzer and the batteries. It may be indicated, parenthetically, that the tubular members, formed of metal, may serve as a single ground or negative, much as the body of an automobile serves as a negative or ground connection with respect to any of the battery operated components or accessories. The preferred circuitry will be described hereinafter in more detail.

In addition to the circular segment 43, in which the switch 14 is mounted; the bracket 41 includes a linear segment 45 and connected thereto an inclined segment 48, which contains a central aperture to receive light bulb 50 having base 50*a* extending therethrough to terminate in a positive terminal 50*b*. Surrounding the base of bulb 50*a* is a generally cone-shaped reflector 50*c*. The cone-shaped reflector is, as shown in FIG. 2, fully assembled in proximity to the arcuate cutout 18*c* in tubular member 18. Connected serially to inclined bracket segment 48 is a vertical segment 47 which, in turn, connects with the bracket segment 44 which, in turn, connects with circular bracket segment 42, much like, but spaced from circular bracket segment 43. Bracket segment 44 serves as a base for buzzer 60 assembly, carried on a pair of springs 61 and 62 surrounding mounting cap screws 63 and 64 threadingly extending through integral ear like flanges buzzer mounted on the bracket segment 44 as shown. The buzzer-like audio alarm within buzzer housing 60 is an off the shelf and readily available piezo-electric, direct current element actuable from 3–28 volts and a maximum of 20 milliamps and manufactured in New York, N.Y. by Amseco as part number PAL-328 N. Reference numeral 61 identifies a circular upstanding speaker, secured to the buzzer by threaded collar 62, which projects upwardly through arcuate cut out 18*b* in tubular member 18, as best seen in FIG. 2. Circular segment 42 contains a central aperture 42*a* and concentric therewith a circular electrical terminal 42*c*. The electrical terminal 42*c*, as can be seen in FIG. 2 is contacted by the terminal 17*a* of the closest battery 17 to conduct flow of direct current from the serially connected array of batteries via appropriate circuitry (not shown) to the switch 14 and specifically, one of the terminals 14*e*. Upon actuation of switch 14, current flows through said appropriate wiring to the positive terminal 50*b* of lamp 50 and to a positive terminal of the piezo-electric type buzzer 60. This circuitry is best understood by reference to schematic drawing in FIG. 5 which clearly illustrates that the lamp or light 50 and the audible, piezo-electric buzzer 60 are connected, in parallel, across the shown positive (+) and negative (−) terminals of the battery, which, in the embodiment, consist of four 1.5-volt batteries arranged in a series, to develop a 6-volt direct current power source 17.

Switch 14 allows the current supply to flow from one of three terminals **14*e* to another of the terminals thence to separate wiring leading to the light and the buzzer independently. From the light and buzzer, current flows to ground, either through appropriate wiring to the spring 21*a* or through the metallic tubular member itself to the soldered disc 21, the spring 21*a* to the base of the end most battery at the end of the four battery array 17** to complete the circuit.

Reference numeral 52 identifies a transparent (lens) plastic cylinder (made from tenite butyrate in the model shown) which telescopically surrounds the tubular member 18, in overlying relationship with the arcuate cut-out **18*c*, beneath which is the lamp assembly, specifically bulb 50 (FIG. 1). This convenience feature allows easy and ready replacement of a worn out or inoperative bulb. Thus, one simply depresses the buzzer speaker 61 and ring 62 to displace the entire speaker assembly within the interior of the tubular member 18 through arcuate cut-out 18*b* thereby accommodating movement of the transparent cylinder 52 to the left into overlying relationship with said arcuate cut out 18*c*. The cylinder thusly retains the buzzer assembly 60 in recessed relationship as permitted by the compression of springs 61 and 62 surrounding mounting screws 63 and 64, whereupon the bulb can be finger removed from bracket segment 48 and a new bulb similarly inserted. Then the transparent cylinder 52 can be moved into overlying relationship with respect to the arcuate cut-out 18*c* while, at the same time, allowing the buzzer housing assembly 60 to return to its normal position as shown in FIG. 2 extending slightly through cut-out 18*b* as urged by the springs 61 and 62. Also by reason of the arrangement of cut-out 18*b* as shown and described hereinabove, the ring 62 of the buzzer can be unthreaded to provide for replacement of the speaker 61 or access to the interior of the buzzer assembly 60** without disassembly of the entire device.

Reference numeral 90 identifies a handle or hook member which is welded, soldered or otherwise secured to the outer surface of tubular member 16 for convenience to the user.

It will be appreciated that the tubular members 16 and 18 may be conveniently fabricated of steel or aluminum and sized in length to meet the particular dimension of the channels of the patio door or window of the users dwelling, residence, office, etc. Usually, tubular member 18, which contains the bracket 41 carrying the operative, alarm elements of the device 11, are fabricated to a uniform given, pre-selected length, while the tubular member 16 is fabricated of various lengths to meet with the pre-selected lengths of member 18, the dimension of the door, window or the like in which the device 11 is to be used. Soldered disc 21 can be secured in any position as will, through the spring **21*a*, compress the four, serially-located batteries with the end most battery terminal 17*a* projecting through aperture 42*a* into contact with soldered terminal 42*c*** to complete the DC circuit in a manner as hereinbefore described.

The elongate device 11, composed of the tubular members 16 and 18, containing an operative array of batteries 17 and with the buzzer 60 and lamp assembly 50 mounted appropriately on the bracket 40 in the manner illustrated in FIG. 2, and with the wiring and circuits completed in a manner as described hereinabove, are usually and novelly adapted to perform its multifunctional utility in the desired manner.

As previously described, this usage is illustrated in FIG. 3, wherein the device 11 is shown located in the lower horizontal track 12 of the sliding door assembly consisting of door panels **12*b* and 12*d* as previously described. Track 12, of course, is the inner of the two parallel tracks 12 and 12*a* as shown in FIG. 1 and contains door panel 12*d*. A potential intruder attempting to move the sliding door 12*d*, to open it, will cause its rear most edge 12*f* to compress the switch contact 14*a* moving the axial armature 14*f* inward, actuating the switch and connecting the source of electricity; e.g.: the batteries 17 simultaneously and independently connect to the lamp or light bulb 50*a* and the buzzer 60**.

As just indicated, separate circuitry or wiring will direct current to each of these elements independent of the other. Immediately, the light is energized into illumination, focused by the reflector **50*c* through the arcuate opening 18*c*, through the lens 18*d* integrally formed in cylinder 52 and upward and outward of the door assembly to flood the attempted intruder. Simultaneously, the piezo-electric buzzer element will sound shrilly, startling the attempted intruder and, as well, serving to awaken anyone within hearing, particularly those within the confines of the residence, office or dwelling in question. Both the light and the buzzer will continue to operate until the switch 14 is again actuated by contact 14*a***. Experience has suggested that, startled and frightened by the simultaneous food of focused light and the shrill buzzer alarm, the prospective intruder leaves. The owner/occupant may then, with some caution and pre-determined expectation that the intruder has, in fact, left, arrange to actuate the switch to the "off" position and thereby discontinue the current flow from the batteries to the lamp and the buzzer audio alarm.

It will be appreciated that the intensity of the light and the sound of the alarm will given an indication of the condition of the batteries. If weaker than desired, the tubular members can be disengaged by rotational movement thereof to disengage the bayonet type connector as previously described to expose the interior of member 16 so that downward inclination thereof, opposite end 20, will allow the four worn batteries to slide out and allow replacement with fresh batteries followed by telescoping engagement of the tubular members, as shown coupled with engagement of the bayonet **18*a* and 16*a***, as previously described.

The device of the present invention possesses further utility in the event that one is not at home. Thus, the floodlight and the audio buzzer alarm will continue to emit their respective alarming signals. The device continues to remain in the track and bar any opening of the sliding door **12*d*** as would permit any entry/access of the intruder.

In summary, ultimate security is provided in that the device 11 absolutely prevents sliding or opening of the door. Preliminarily, any attempt to open the door by sliding the door in an opening direction will actuate the independently powered light and audio buzzer alarm serving to doubly alarm or startle the attempted intruder. As has previously been indicated, should the buzzer be defective, or the light be defective, such will not break the circuit to the other alarm element since they are connected in parallel rather than in series.

In accordance with a further embodiment of the present invention, the device 11 may be constructed to employ household alternating current instead of the direct current as supplied by the internal batteries. In this embodiment, in place of batteries, a transformer is employed. The transformer converts 110-volt alternating current to 6-volt direct current suitable for the sound alarm and light alarm elements. This, of course, necessitates employment of means such as an extension corn for connecting the transformer (110-volt AC to 6-volt DC) located within, for example, housing member 16 to a source of alternating current such as the wall plug provided in most residences, apartments, offices, and the like. The 110-volt alternating current is easily carried by appropriate insulated wire directed through an opening in the wall of the tubular member 16 for connection to the appropriate terminals of the transformer positioned therewithin. Alternatively, of course, 110-volt AC to 6-volt DC transformers are available in the form of a plug/box combination which, includes appropriate prongs for the normal 110-volt receptacle and a length of wire extending to any unit requiring direct current (DC) such as a 9-volt direct current powered radio or direct current powered battery (Ni-Cd) charger or the like.

Within the framework or scope, as described, the device of the present invention may employ nickel cadmium rechargeable type batteries as the power source with an AC-DC transformer type charger built into the tubular member and with external provisions for connecting to a 110-volt alternating current source so that the batteries are continuously or intermittently recharged as desired.

An advantage of the embodiment employing household alternating current is that the alarms once initiated by actuation of the switch, continues essentially indefinitely rather than limited to the capacity of the DC batteries. On the other hand, the alternating current actuation requires a convenient source or outlet for alternating current and, of course, the inconvenience and/or unsightliness of employing an extension cord, appropriate wiring or the like to the device 11.

In a more detailed and elaborate embodiment of the present invention, the transparent cylindrical sleeve member 52 enveloping the tubular member 16 in covering relationship with the arcuate cut-out, in proximity to the light source, is of special design. Thus, the transparent sleeve is of particular and optical properties selected to focus and control the light emanating from the bulb through the arcuate opening. In this embodiment, it is envisioned that a variant plurality of transparent cylindrical sleeve members would be designed and available for purchase by a user desiring to achieve a particular pre-designed focusing or dispersion of the light waves depending upon the particular security situation peculiar to the proposed use of the device of the present invention.

By way of further example, the transparent sleeve can embody a lens 18*d* to diffuse the light generally and, at the same time, include a separate lens to focus a portion of the light passing therethrough to impinge directly on a photoelectric cell device remote from the device of the present invention itself. In accordance with this embodiment, the photoelectric cell is electrically connected to a source of electricity and appropriate circuitry leaving to an alarm remote from the device as for example, a centralized monitoring station located at the security office for the particular building, be it office, apartment or the like.

In this fashion, any attempt to open a sliding door or window anywhere equipped with a device of the present invention, will result in an immediate alarm at the site by actuation of the shrill/buzzer and the floodlight while at the same time, a portion of the light is focussed on a light sensitive, photoelectric cell designed to be actuated by that focused light and propagate through appropriate circuitry, known in the art, to an alarm board situated at a central security post or the like.

Figure 6:
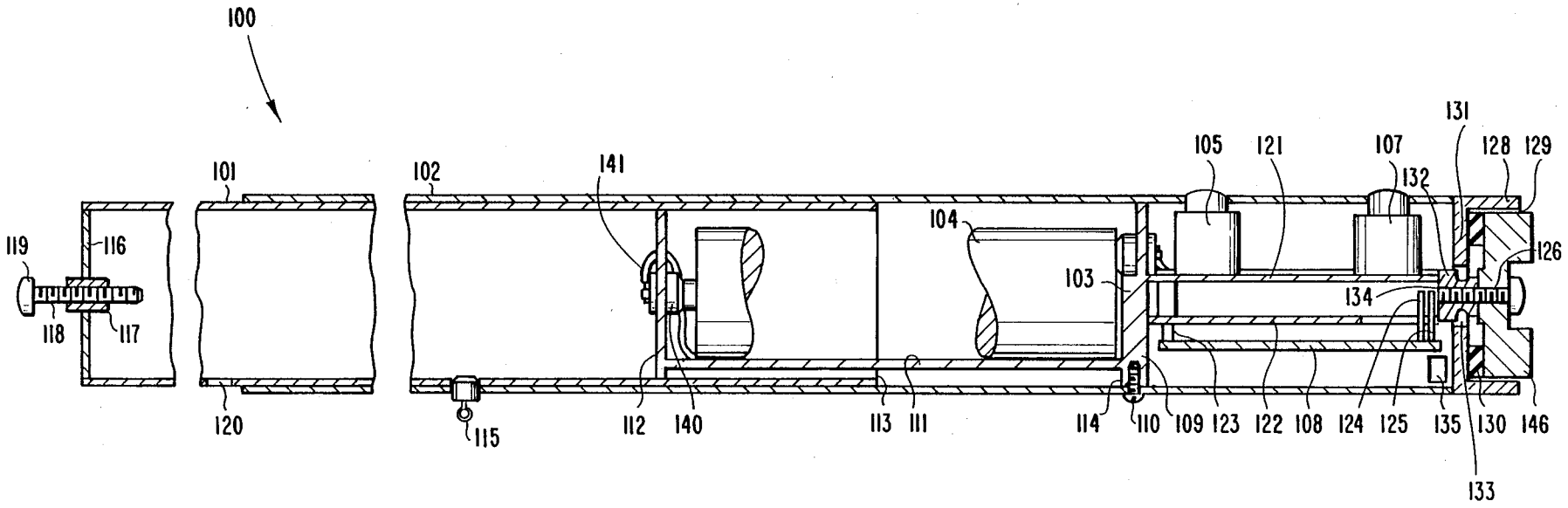
FIG. 6 is the same view as FIG. 2 only showing the preferred embodiment of the security device.

The preferred embodiment of the security device is shown in cross-section in FIG. 6. Security device 100 includes a pair of elongated hollow tubes 101 and 102 telescopically connected together. Fixedly mounted within tube 102 is a frame 103 for holding the batteries 104, buzzer alarm 105 and visual alarm 107. In addition, a printed circuit board 108 is mounted to frame 103 and carries the various electronic components to connect the source of electrical energy with the alarms and with the various switches.

Frame 103 includes a center portion or intermediate wall 109 fixedly secured to tube 102 by a conventional fastening device such as screw 110. Batteries 104 are positioned in series atop the horizontally extending wall 111 cantileveredly mounted to wall 109. The opposite end of wall 111 is integrally connected to end wall 112 perpendicularly arranged thereto. End wall 112 has a diameter less than the inside diameter of tube 101 allowing tube 101 to slide within outer tube 102 pass wall 112 until the inner end 113 of tube 101 contacts stop surface 114 of wall 109. Tubes 101 and 102 are removably secured together by means of a conventional pin 115 which is removable, but press fitted through a pair of aligned apertures formed in tubes 101 and 102. A plurality of apertures 120 are formed in inner tube 101 and are alignable with the aperture formed in outer tube 102 to allow extension or retraction of tube 101 to fit the particular window or door frame such as depicted and described for the alternate embodiment of FIG. 3. Further, end cap 116 secured to the end of inner tube 101 is provided with an internally threaded boss 117 by meshing engagement with threaded member 118 having an outer stop 119 secured thereto. Member 118 may be threaded inwardly or outwardly to position stop 119 against the door or window frame thereby providing further adjustment of the length of the telescopically constructed tubes.

Alarms 105 and 107 are mounted atop wall 121 which is integrally joined to and extends to the right of wall 103. A second horizontally extending wall 122 is perpendicularly arranged and integrally connected to wall 103 and has a printed circuit board 108 fixedly mounted thereto by downwardly projecting mounting posts 123. A pair of contacts 124 and 125 extend upwardly from board 108 through wall 122 to a position immediately adjacent threaded member 126.

Security device 100 includes a depressible switch means mounted to the right end of tube 102 which is operable to connect the source of electrical power provided by batteries 104 to the alarms 105 and 107. The switch means includes a cylindrical rigid member 146 slidably received in guide 128 fixedly secured to tube 102. Guide 128 has a cylindrical outwardly opening cavity 129 in which rigid member 146 is movable. A compressible gasket or washer 130 is positioned between the mutually facing surfaces of rigid member 146 and vertical wall 131 of guide 128. Threaded member 126 is fixedly secured to and movable with rigid member 146. A thumb nut 132 is threadedly mounted to the inwardly projecting end of threaded member 126 and is movable with the threaded member whenever rigid element 146 moves relative to guide 128 and tube 102. A centrally located aperture 133 allows thumb member 132 to move through wall 131. In operation, the inwardly facing surface 134 of thumb nut 132 contacts and forces together contacts 124 and 125 as rigid member 146 is depressed into guide 128 resulting from movement of the sliding door or window. A plurality of openings 135 are positioned in tube 102 immediately adjacent thumb nut 132 to allow the user to extend a finger or other elongated element through the tube against thumb nut 132 to rotate nut 132 in relationship to threaded member 126 thereby providing an adjustable means to adjustingly control the spacing between contacts 124–125 and contact surface 134. Such presetting allows for the predetermination of the sensitivity of the switch means to movement of the sliding door or window.

Figure 5:
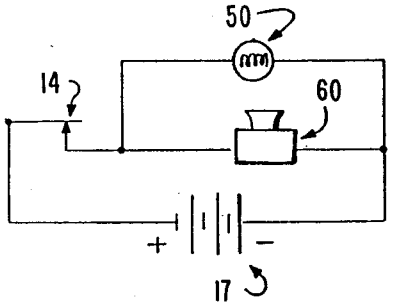
FIG. 5 is a schematic diagrammatic view of the electric circuit incorporated in the device of FIG. 2.

The electrical circuit required to connect the batteries to the two alarms as well as to the activating switch may be as depicted in FIG. 5 or any other conventional circuit with the components limiting or amplifying the current being mounted to printed circuit board 108. Likewise, alarms 105 and 107 may be identical to the alarms previously described as alarms 60 and 50 (FIG. 2). In the preferred embodiment shown in FIG. 6, contacts 124 and 125 are metal and are cantileveredly mounted to printed circuit board 108 being normally spaced apart, but which will move together as surface 134 moves to the left as viewed in FIG. 6 and forces contact 125 against 124 thereby completing the circuit and connecting the alarms to the source of electrical energy. A conventional contact 140 mounted to wall 112 connects one end of the batteries to wire 141 which extends to the right to the printed circuit board and eventually to contact 124 with the opposite end of the row of batteries being connected by separate wire to the circuit board and eventually to the remaining contact 125.

Device 100 provides a portable self-controlled security device for sliding doors or windows. The device is operable with an internally located source of electrical power provided by batteries 104 or conventional circuitry may be employed to connect the device to an external source of power. Wall 111 provides an electrical power source means mounted within the tubes which when filled with batteries provide a suitable source of power. The thumb nut 132 provides an adjustable means which is operable to adjustingly control the spacing between the two contacts 124 and 125 and a movable means which includes the thumb nut, threaded member 126 and rigid element 146. Thus, the sensitivity of the switch means may be preset to movement of the sliding door or window. The switch means includes the first and second contacts 124 and 125 along with threaded member 126 and element 146. The compressible washer 130 provides a spring means operable to allow element 146 to move towards contacts 124 and 125.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A portable, self-contained security device for sliding doors or windows comprising:

elongate means adapted for positioning, in axial alignment with the plane of a sliding door or window and in the marginal path of its normally sliding opening to prevent opening;

electrical power source means mounted to said elongate means;

alarm means mounted to said elongate means and connectable to said electrical power source means;

depressible switch means mounted to an end of said elongate means and including first and second contacts mounted to said elongate means and movable means mounted to an end of said elongate means and associated with said contacts being operable to move said contacts together and connect said electrical power source means with said alarm means when said switch means is depressed by movement of said sliding door or window; and, adjustable means operable to adjustingly control the spacing between said contacts and said movable means allowing presetting of sensitivity of said switch means to movement of said sliding door or window.

2. A security device of claim 1 wherein:

said switch means includes a threaded member in meshing engagement with said adjustable means.

3. The security device of claim 2 wherein:

said switch means includes a rigid member slidably mounted to an end of said elongate means with said threaded member mounted to said rigid member, said switch means further includes spring means located adjacent said rigid means operable to allow said rigid member with threaded member to move toward said first and second contacts; and, said adjustable means includes an adjust member threaded to an end of said threaded member and movable therewith to contact said first and second contacts with said adjust member accessible to allow the user to move same lengthwise on said threaded member controlling said spacing.

4. The security device of claim 3 wherein:

said elongate means includes a pair of hollow tubes telescopically connected together and said alarm means includes a visual alarm and a audio alarm connectable to said power source which includes a plurality of batteries positioned within one of said tubes.

5. The security device of claim 4 wherein:

said elongate means includes a frame positioned and mounted within one of said tubes with said frame including said visual alarm, said audio alarm and said plurality of batteries thereon, said frame includes a guide on one end thereof which slidably receives said rigid member with said spring means located between said guide and said rigid member.

6. A portable, self-contained security device for sliding doors or windows comprising:

elongate means adapted for positioning, in axial alignment with the plane of a sliding door or window and in the marginal path of its normally sliding opening to prevent opening;

an electrical power source mounted to said elongate means;

alarm means mounted to said elongate means and connectable to said electrical power source;

depressible switch means mounted to an end of said elongate means and including contact means mounted to said elongate means and movable means mounted to an end of said elongate means and associated with said contact means being operable to move relative to said contact means and connect said electrical power source with said alarm means when said switch means is depressed by movement of said sliding door or window; and, adjustable means operable to adjustingly control the spacing between said contact means and said movable means allowing presetting of sensitivity of said switch means to movement of said sliding door or window.

7. The security device of claim 6 wherein:

said switch means includes a threaded member in meshing engagement with said adjustable means.

8. The security device of claim 7 wherein:

said switch means includes a rigid member slidably mounted to an end of said elongate means with said threaded member mounted to said rigid member, said switch means further includes spring means located adjacent said rigid means operable to allow said rigid member with threaded member to move toward said contact means; and, said adjustable means includes an adjust member threaded to an end of said threaded member and movable therewith to contact said contact means with said adjust member accessible to allow the user to move same lengthwise on said threaded member controlling said spacing.

9. The security device of claim 8 wherein:

said elongate means includes a pair of hollow tubes telescopically connected together and said alarm means includes a visual alarm and a audio alarm connectable to said power source which includes a plurality of batteries positioned within one of said tubes.

10. The security device of claim 9 wherein:

said elongate means includes a frame positioned and mounted within one of said tubes with said frame including said visual alarm, said audio alarm and said plurality of batteries thereon, said frame includes a guide on one end thereof which slidably receives said rigid member with said spring means located between said guide and said rigid member.

11. A portable, self-contained security device for sliding doors or windows comprising:

elongate means adapted for positioning, in axial alignment with the plane of a sliding door or window and in the marginal path of its normally sliding opening to prevent opening;

electrical power source means;

alarm means connectable to said electrical power source means;

depressible switch means mounted to an end of said elongate means and including contact means mounted to said elongate means and movable means mounted to an end of said elongate means and associated with said contact means being operable to move relative to said contact means and connect said electrical power source means with said alarm means when said switch means is depressed by movement of said sliding door or window; and, adjustable means operable to adjustingly control said switch means allowing presetting of sensitivity of said switch means to movement of said sliding door or window.

12. The security device of claim 11 wherein:

said adjustable means is operable to adjustingly control the spacing between said contact means and said movable means.

13. The security device of claim 11 wherein:

said switch means includes a guide with a outwardly opening cylindrical cavity slidably receiving said movable means which includes a cylindrical rigid member, said switch means further includes a compressible washer located between said cylindrical rigid member and a threaded member mounted to said cylindrical rigid member and extending through said washer to said contact means; and, said adjustable means includes an internally threaded element mounted to an inner end of said threaded member, said internally threaded element has a surface engagable with said contact means when said rigid member and said threaded element are moved inwardly toward said contact means by movement of said sliding door or window to connect said power source means with said alarm means.

14. The security device of claim 13 wherein:

said elongate means includes a frame with a first section for holding said electrical power source means, a second section in which is located said alarm means, and a stop surface located between said first section and said second section; and, said elongate means includes a pair of telescopically constructed tubes with one of said tubes fixed to said elongate means between said first section and said second section and with the other of said tubes slidable on said first section toward said second section until contacting said stop surface.

15. The security device of claim 13 wherein:

one of said tubes fixed to said elongate means includes an opening to access and rotate said internally threaded element.

* * * * *